US010830009B2

(12) United States Patent
Orban

(10) Patent No.: US 10,830,009 B2
(45) Date of Patent: Nov. 10, 2020

(54) CONTINUOUS MUD CIRCULATION DURING DRILLING OPERATIONS

(71) Applicant: Schlumberger Technology Corporation, Houston, TX (US)

(72) Inventor: Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 464 days.

(21) Appl. No.: 14/983,048

(22) Filed: Dec. 29, 2015

(65) Prior Publication Data

US 2016/0326817 A1 Nov. 10, 2016

Related U.S. Application Data

(60) Provisional application No. 62/157,853, filed on May 6, 2015.

(51) Int. Cl.

| | |
|---|---|
| ***E21B 19/16*** | (2006.01) |
| ***E21B 41/00*** | (2006.01) |
| ***E21B 3/02*** | (2006.01) |
| ***E21B 21/10*** | (2006.01) |

(52) U.S. Cl.
CPC ..... *E21B 19/16* (2013.01); *E21B 21/106* (2013.01)

(58) Field of Classification Search
None
See application file for complete search history.

(56) References Cited

U.S. PATENT DOCUMENTS

| | | | | |
|---|---|---|---|---|
| 3,822,902 | A * | 7/1974 | Maurer | E21B 17/042 285/94 |
| 5,212,885 | A * | 5/1993 | Buonodono | B23P 19/066 29/407.02 |
| 6,591,916 | B1 | 7/2003 | Ayling | |
| 6,803,757 | B2 | 10/2004 | Slates | |
| 8,511,389 | B2 | 8/2013 | Fenton | |
| 2002/0157838 | A1 * | 10/2002 | Ayling | E21B 19/16 166/380 |
| 2004/0174163 | A1 | 9/2004 | Rogers et al. | |
| 2007/0017682 | A1 | 1/2007 | Abrahamsen et al. | |
| 2007/0240875 | A1 | 10/2007 | Van Riet | |
| 2009/0151934 | A1 | 6/2009 | Heidecke et al. | |
| 2011/0174500 | A1 | 7/2011 | Davies et al. | |
| 2013/0283917 | A1 | 10/2013 | Coonrod et al. | |
| 2014/0124267 | A1 | 5/2014 | Ayling | |
| 2014/0202767 | A1 | 7/2014 | Feasey | |

(Continued)

FOREIGN PATENT DOCUMENTS

WO 02-036928 A1 5/2002

*Primary Examiner* — Matthew R Buck
*Assistant Examiner* — Douglas S Wood
(74) *Attorney, Agent, or Firm* — Rachel E. Greene

(57) ABSTRACT

Systems and methods for continuous mud circulation during a drilling operation. The method includes delivering a first flow of drilling mud from a mud supply, through a drill string, into a wellbore, and through a blowout preventer. The drill string is received through the blowout preventer. The method also includes delivering a second flow of drilling mud into the blowout preventer. The second flow is not delivered through the drill string. The method further includes stopping the first flow, and removing or adding a tubular to or from the drill string when the first flow is stopped and while continuing to deliver the second flow.

25 Claims, 10 Drawing Sheets

(56) References Cited

U.S. PATENT DOCUMENTS

| | | | |
|---|---|---|---|
| 2014/0231073 | A1 | 8/2014 | Teodorescu et al. |
| 2014/0262510 | A1 | 9/2014 | Beddoes et al. |
| 2015/0191977 | A1 | 7/2015 | Skjaerseth et al. |
| 2016/0002984 | A1 | 1/2016 | Grice |

* cited by examiner

CONTINUOUS MUD CIRCULATION DURING DRILLING OPERATIONS

CROSS-REFERENCE TO RELATED APPLICATIONS

This application claims priority to U.S. Provisional Patent Application having Ser. No. 62/157,853, which was filed on May 6, 2015 and is incorporated herein by reference in its entirety.

BACKGROUND

During drilling operations, drilling mud may be pumped into the wellbore. When flowing upwards in the annulus between the drill string and the wellbore, the drilling mud may remove drill cuttings, reduce friction, etc., which may facilitate the drilling process. Also depending on pressure distribution between the wellbore and formation, the mud may be loaded with formation fluids such as water, oil and gas produced by some formations.

The drilling fluid may be delivered into the wellbore through the drill string. The drill string may be rotatable, so as to rotate the drill bit, for at least a portion of the drilling operations. Mud may also be used to power a mud motor within the drill string, which may be employed to provide rotation of the distal portion of the drill string. In many drilling systems, the delivery conduit for the mud may be coupled to an interior of the drill string, e.g., through the top drive.

During the drilling process, some connections at the top of the drill string may be broken, to add or remove drill string tubulars. For example, when drilling a new well, drill pipe(s) are added when the top drive reaches the rig floor, as the well is bored progressively longer. This is an example of "tripping in" the drill pipe. To accomplish this, the connection between the drill string and the top drive may be broken, so as to allow for connection to the next drill pipe to be tripped in. During "trip-out," the opposite process is performed: as each drill pipe is removed from the well, connections at both ends of the upper drill pipe are broken, allowing for removal of the drill pipe from the drill string.

When the connection between two pipes, or between the top drive and a pipe, is broken during trip-in or trip-out, the pumping of mud generally ceases. However, when the pumping is stopped, formation fluid may enter in the wellbore as the total wellbore pressure is lowered, as the hydraulic loss in the annulus is suppressed by the no-flow condition. Such fluid may create hazards, such as risk of fire or explosion at the surface, and may also affect wellbore stability. Further, cuttings may settle in the annulus between the drill string and the wellbore, which may increase the risk of stuck-pipe. Additionally, the filter cake at the bore wall may be affected with risk of additional invasion in some formations, which may reduce productivity along the reservoir, as well as creating a risk for wellbore instability. In addition, gas pressure may rise when the mud no longer circulates through the drill string.

SUMMARY

Embodiments of the disclosure may provide a method for continuous mud circulation during a drilling operation. The method includes delivering a first flow of drilling mud from a mud supply, through a drill string, into a wellbore, and through a blowout preventer. The drill string is received through the blowout preventer. The method also includes delivering a second flow of drilling mud into the blowout preventer. The second flow is not delivered through the drill string. The method further includes stopping the first flow, and removing or adding a tubular to or from the drill string when the first flow is stopped and while continuing to deliver the second flow.

Embodiments of the disclosure may also provide a system for drilling a wellbore. The system includes a blowout preventer configured to be disposed above a wellbore. The blowout preventer is configured to receive a drill string therethrough. The system also includes a rotating control device coupled to the blowout preventer, such that the blowout preventer is configured to be positioned between the wellbore and the rotating control device. The rotating control device is configured to receive the drill string therethrough. The system also includes a drilling device configured to rotate the drill string and lower the drill string through the blowout preventer and the rotating control device, wherein the drilling device has a conduit that is configured to communicate with an inner bore of the drill string. The system further includes a first mud supply line fluidly coupled to the drilling device, so as to deliver a first mud flow into the drill string via the drilling device. The system additionally includes a second mud supply line coupled to the blowout preventer, so as to deliver a second mud flow thereto. The second mud flow does not extend through the drilling device.

It will be appreciated that the foregoing summary is provided merely to introduce a subset of the features of the present disclosure, which are described in greater detail, along with other aspects of the present disclosure, below. The foregoing summary is, therefore, not to be considered exhaustive or otherwise limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures.

In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
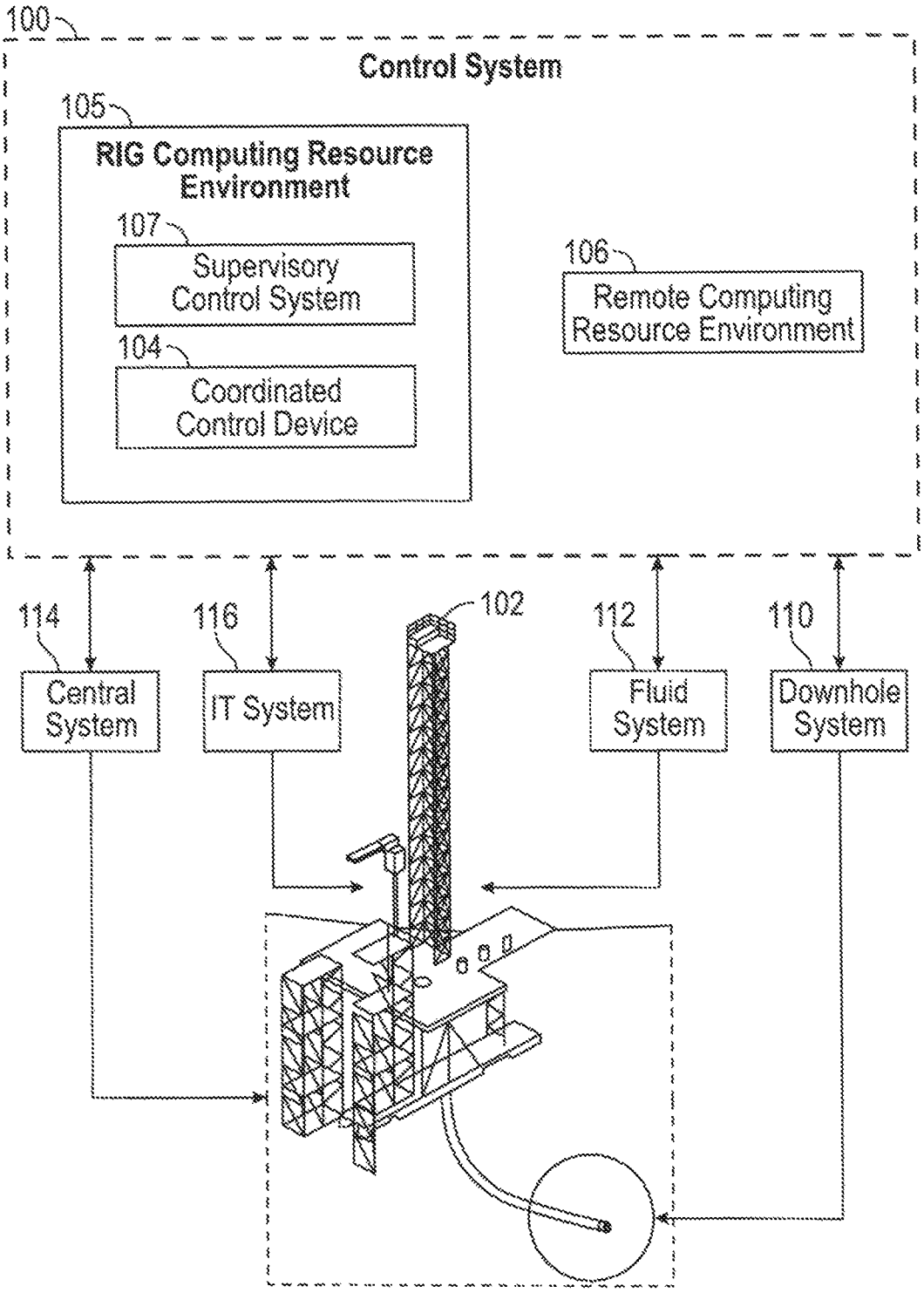
FIG. 1 illustrates a schematic view of a drilling rig and a control system, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottomhole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
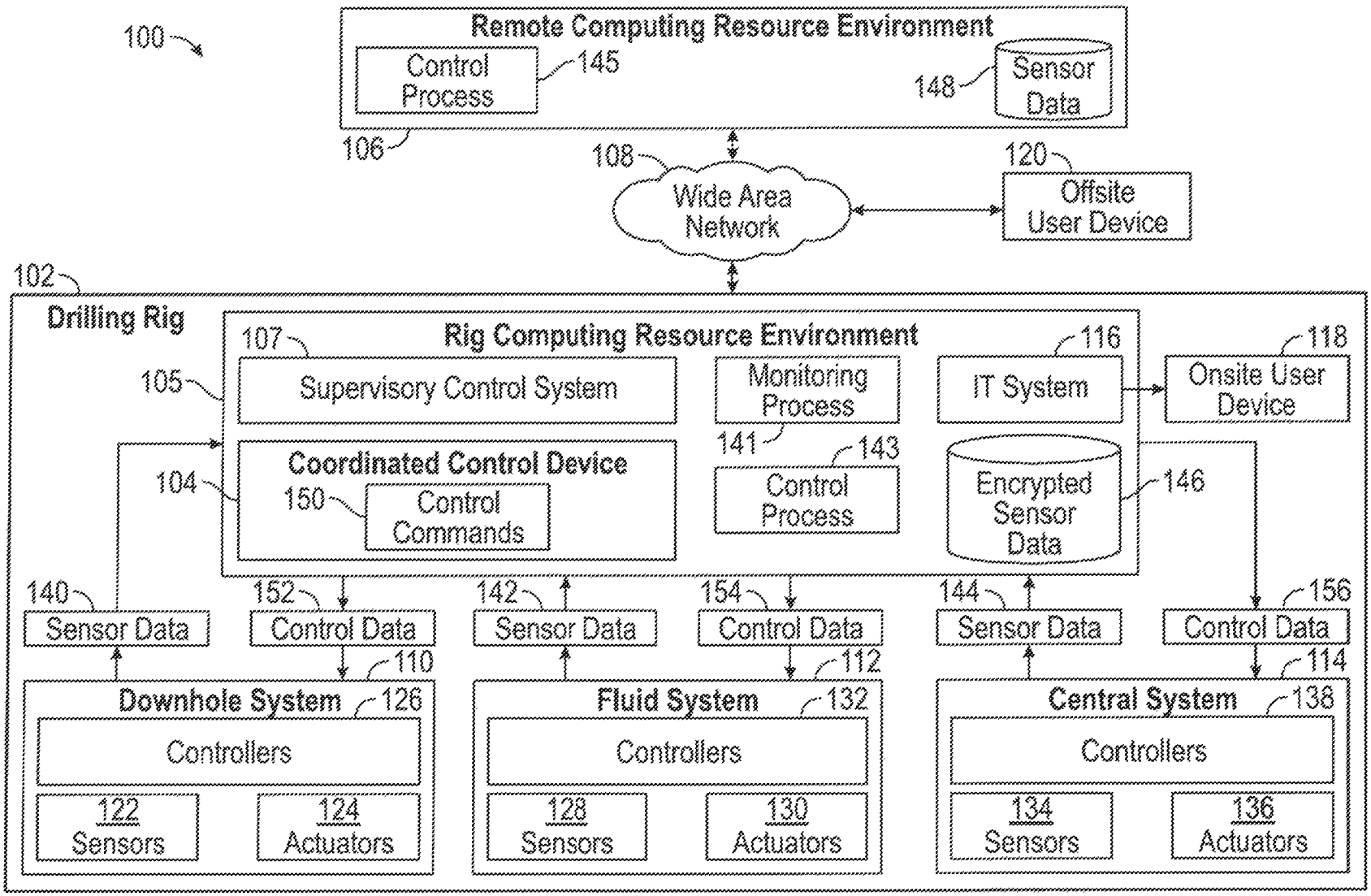
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 3:
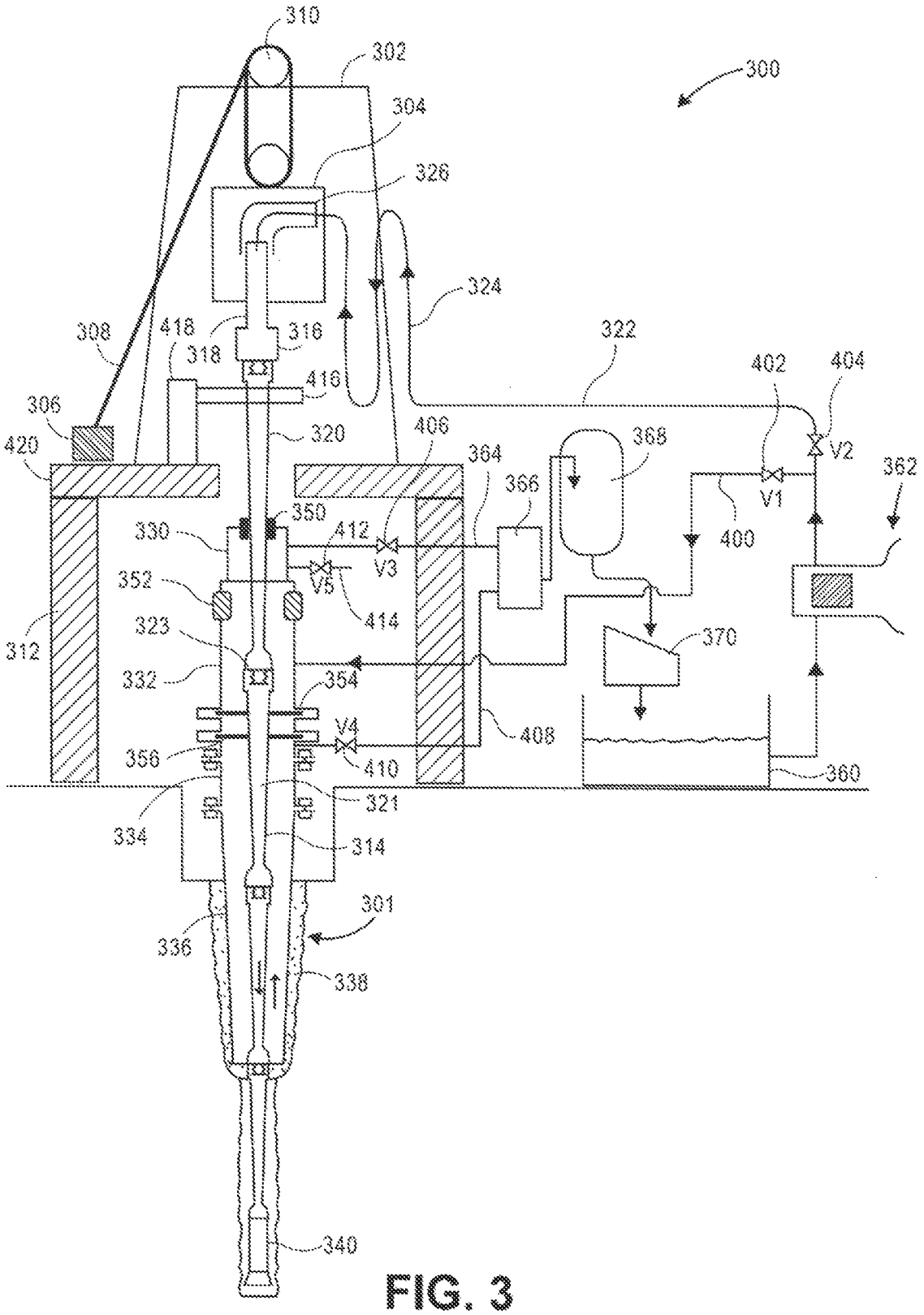
FIG. 3 illustrates a conceptual, schematic view of a drilling system, according to an embodiment.

FIG. 3 illustrates a conceptual, schematic view of a drilling system 300, according to an embodiment. The drilling system 300 may be located partially above and partially within a wellbore 301, as shown, e.g., after drilling operations have commenced. The drilling system 300 may include a mast 302 from which a top drive 304 (or another tubular-rotating and/or tubular-supporting, drilling device) is movably supported. For example, the top drive 304 may be raised and lowered along the mast 302 using a drawworks 306 coupled to the top drive 304 via a drilling line 308 received through a set of sheaves 310.

The drilling system 300 may also include a rig substructure 312 that may support the mast 302 and the structures coupled therewith. The rig substructure 312 may straddle the wellbore 301. A drill string 314 may be received through an opening in the rig substructure 312 and may extend into the wellbore 301. The drill string 314 may be supported by the top drive 304, e.g., via a connection with a shaft 316 (or "quill") that is rotated by the top drive 304. The shaft 316 may define a neck 318, which may be connected to the box-end connection of the upper-most tubular 320 of the drill string 314. The upper-most tubular 320 may connect with a next tubular 321 at a connection 323. A mud supply line 322, which may include a standpipe 324, may be coupled to an interior of the shaft 316 via a conduit 326 within the top drive 304. The top drive 304 may rotate the shaft 316, and a rotary seal (not shown) between the conduit 326 and the shaft 316 may retain the pumped fluid inside the bore of the conduit 326 and shaft 316.

The drill string 314 may also be received through a rotating control device ("RCD") 330, a blowout preventer ("BOP") 332, and a wellhead 334. The RCD 330 may be (e.g., releasably) coupled to the BOP 332 and positioned above the BOP 332, as shown, such that the BOP 332 is positioned between the RCD 330 and the wellhead 334. Below the wellhead 334, the drill string 314 may extend into the wellbore 301, which may be, as shown, partially cased with a casing 336 and/or cemented with a cement layer 338. The drill string 314 may extend to its distal terminus, where a bottom hole assembly ("BHA") 340, e.g., including a drill bit, may be located.

The RCD 330 may include an RCD seal 350, e.g., at or toward the top thereof, so as to provide a fluid-tight seal with the drill string 314. The BOP 332 may include an elastomeric annular body or seal, which may be referred to as a BOP annular preventer or, more succinctly, a BOP annular 352. The BOP annular 352 may be selectively opened and closed, such that a seal is formed with the drill string 314 when the BOP annular 352 is closed.

The BOP 332 may also include a pipe ram 354 and a tubular lock 356, which may both be positioned below the BOP annular 352. The relative position of the pipe ram 354 and tubular lock 356 may be as shown, with the pipe ram 354 vertically above the tubular lock 356, or may be reversed. The pipe ram 354 may be configured to seal the annulus between the BOP 332 and the drill string 314, and the tubular lock may be configured to prevent the drill string 314 from rotating, when engaged. Further, either or both of the pipe ram 354 and the tubular lock 356 may be employed to support the weight of the drill string 314 within the wellbore 301. Moreover, the BOP 332 may be coupled to or otherwise positioned above (e.g., directly above) the wellhead 334.

During drilling operations, a fluid or slurry "drilling mud" is provided into the wellbore 301 through the drill string 314, e.g., to remove cuttings, maintain bottom hole pressure, reduce friction, etc. The mud may be provided from a pit (or tank) 360, and may be pumped through the mud supply line 322 via a pump 362. The pump 362 may be referred to as a mud triplex, as it may be provided by a three-piston pump; however, any suitable type of pump may be employed. In the illustrated embodiment, the mud pumped through the mud supply line 322 is delivered through the conduit 326 of the top drive 304, the shaft 316, the drill string 314, and the BHA 340, to the distal end of the wellbore 301. The mud then circulates back up through the wellbore 301, through the wellhead 334, the BOP 332, and the RCD 330.

The drilling system 300 may include a flow line 364, which may receive the mud from the RCD 330, and deliver the mud to a choke 366, which may be employed, e.g., to manage pressure during drilling (e.g., as part of a managed pressure drilling (MPD) operation). From the choke 366, the mud may be delivered to a mud-gas separator ("MGS") 368, which may remove gases therefrom. From the MGS 368, the mud may be delivered to a shale shaker 370, which removes particulates therefrom, and finally may be delivered back to the mud pit 360. This may be the primary flowpath for the drilling mud, e.g., through the top drive 304 and the drill string 314, into the wellbore 301, and out through the BOP 332 and the RCD 330. The flow of drilling mud through this flowpath may be referred to as a "first" flow of the drilling mud.

The drilling system 300 may also provide a secondary flowpath through which a second flow of fluid may proceed. For example, in the illustrated embodiment, the drilling system 300 includes a second or "alternate" mud supply line 400, which may extend from the mud supply line 322 to the BOP 332, below the BOP annular 352. A first valve (V1) 402 may be disposed in the alternate mud supply line 400. When open, the first valve 402 may divert mud from the mud supply line 322, and deliver it directly to the BOP 332. Moreover, the mud supply line 322 may include a second valve (V2) 404, which may, for example, be closed to block mud flow to the top drive 304 via the mud supply line 322. Similarly, the flow line 364 may include a third valve (V3) 406 configured to open and close, allowing and blocking, respectively, mud flow from the RCD 330 to the choke 366.

The drilling system 300 may also include a second or "alternate" flow line 408, which may extend from the BOP 332 to the choke 366. For example, the alternate flow line 408 may extend from a position below the pipe ram 354. The alternate flow line 408 may also include a fourth valve (V4) 410, which may open and close to allow and prevent, respectively, a mud flow from the BOP 332 directly to the choke 366. The drilling system 300 may further include a bleed line 414, which may include a fifth valve (V5) 412 that is similarly operable with respect to the bleed line 414, and may be employed to relieve pressure in the RCD 330 when the BOP annular 352 is closed. In various embodiments, the bleed line 414 may be connected to the choke 366, the MGS 368, or the mud pit 360. The second flow of drilling mud may thus employ these alternate lines 400, 408, and may be delivered to and received directly from the BOP 332.

The drilling system 300 may further include an RCD seal locator 416 and an actuator 418 positioned at or above a rig floor 420 of the rig structure 312. The RCD seal locator 416 may be configured to move with and/or apply a moving force, e.g., via the actuator 418, to the RCD 330 or a part thereof. Accordingly, the RCD seal locator 416 may be configured to maintain the RCD seal 350 at a chosen position above the rig floor 420 while the RCD seal 350 is still on the shaft 316.

Figure 4A:
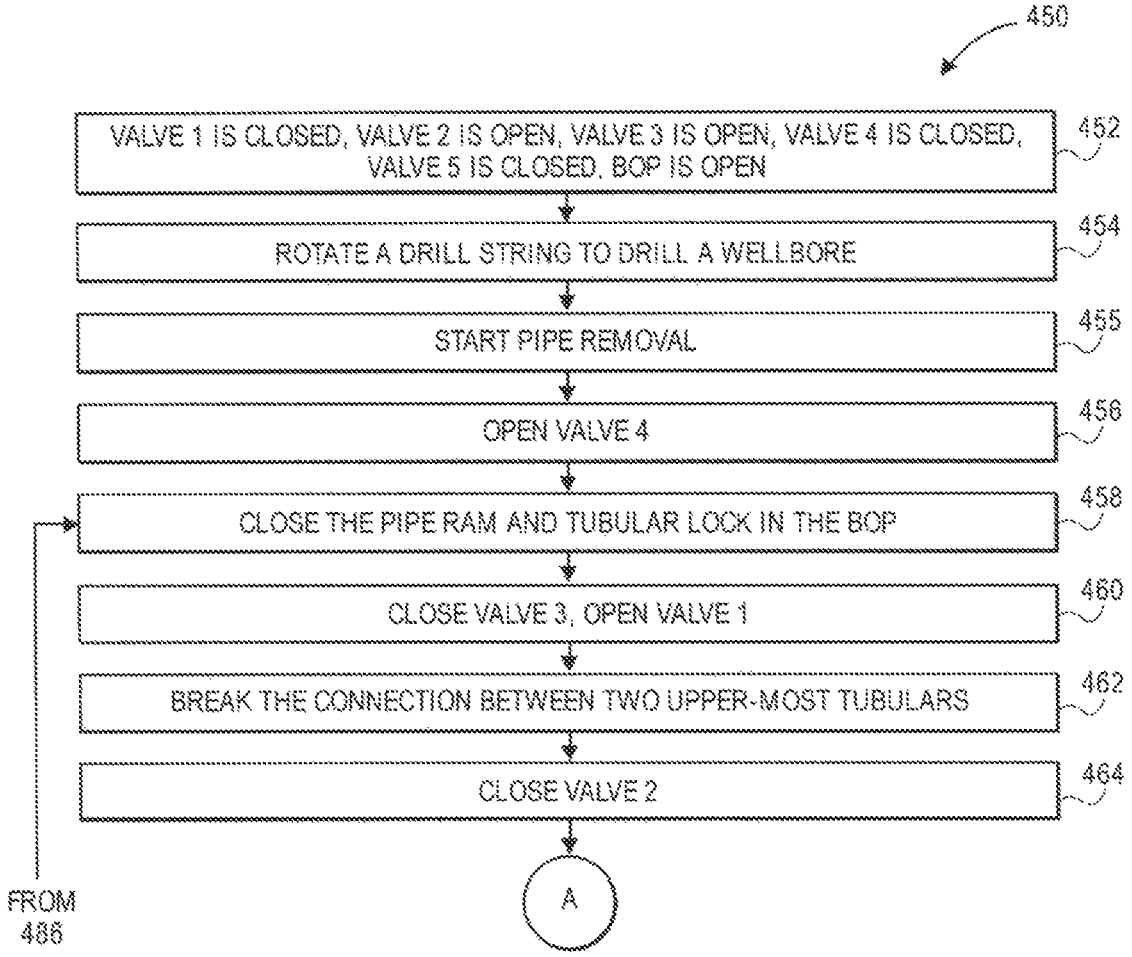
FIGS. 4A and 4B illustrate a flowchart of a method for continuous mud circulation during a drilling operation (e.g., during trip-out), according to an embodiment.
Figure 4B:
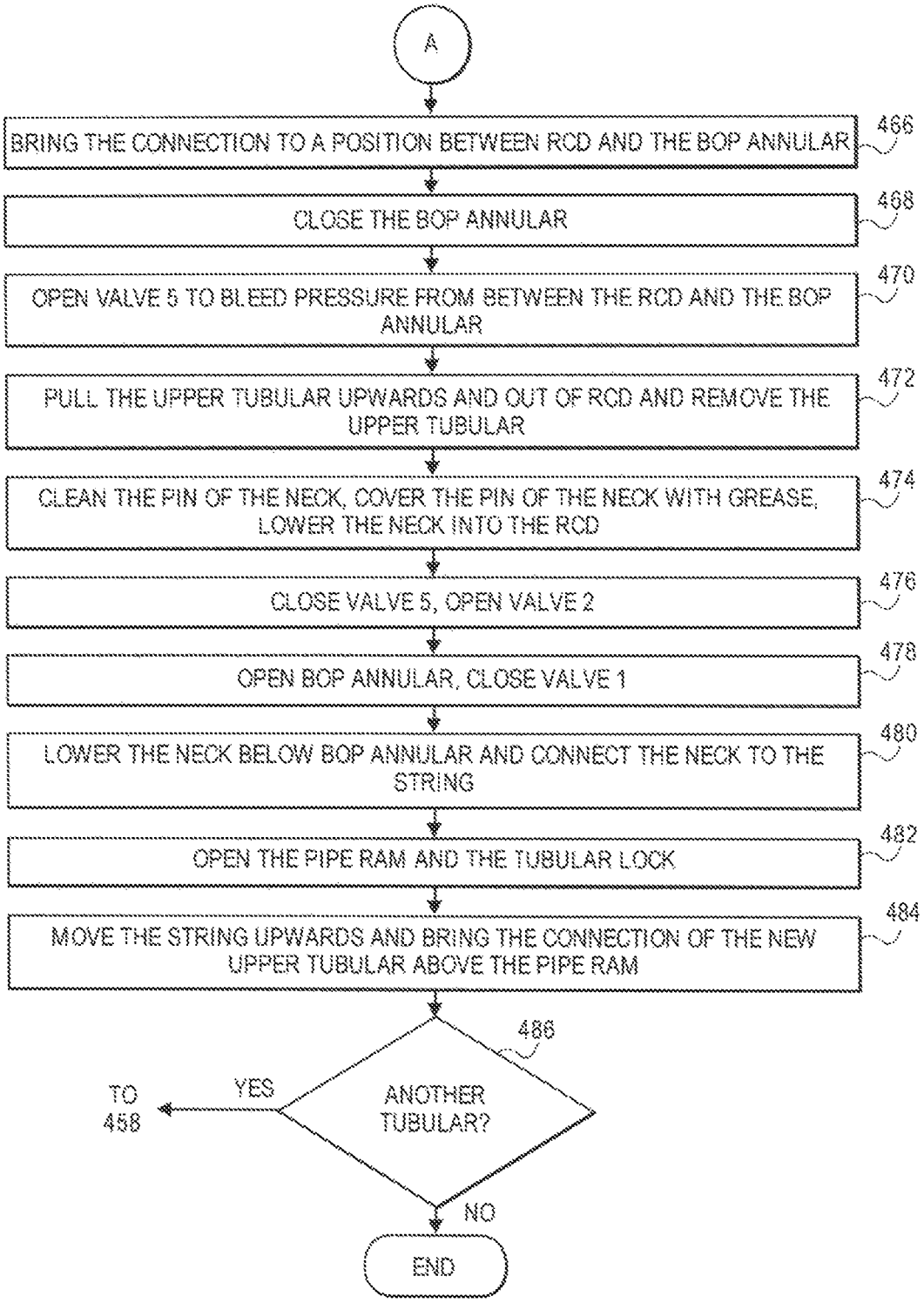

Referring now additionally to FIGS. 4A and 4B, there is shown a flowchart of a method 450 for continuous mud circulation while drilling, according to an embodiment. The flowchart illustrates the method 450 beginning in a "normal" drilling configuration, although this starting point is not to be considered limiting, as the method 450 may start in any suitable configuration of the system 300 (or another system). In this instance, as indicated at 452, the first valve 402 may be closed, while the second valve 404 is open. As such, mud may be delivered from the mud pump 362 to the top drive 304 and downhole through the drill string 314. Further, the third valve 406 and the BOP annular 352 may be open, allowing mud circulated back through the wellhead 334 and the BOP 332 to be delivered to the choke 366 via the flow line 364. Further, the fourth and fifth valves 410 and 412 may be closed. That is, the first mud flow may be delivered to and received from the wellbore 301, while the second flow may be prevented. In this configuration, the method 450 may include rotating the drill string 314 to drill the wellbore 301, as at 454.

At some point, it may be desired to remove one or more tubulars of the drill string 314 from the wellbore 301, as indicated at 455. In such instances, the rotation of the drill string 314 may be stopped. Also, according to embodiments of the present method 450, when the drill string 314 is raised sufficiently, the upper-most tubular (or tubular set such as triple) 320 may be disconnected from the next tubular 321, and removed from the drill string 314 while continuing to circulate mud downhole. To accomplish this, the method 450 may include opening the fourth valve 410, as at 456, which may open the alternate flow line 408, directing some of the mud from the BOP 332 to the choke 366.

The method 450 may then proceed to closing the tubular lock 356 and the pipe ram 354, as 458. As mentioned above, the tubular lock 356 may hold the drill string 314 in the BOP 332 and prevent the tubular 321 from rotating, while the pipe ram 354 may generally seal the wellhead 334 from the BOP 332 above the pipe ram 354. After closing the pipe ram 354, the mud flow out of the wellbore 301 passes through the fourth valve 410 and flow line 408, e.g., to reach the choke 366.

As shown in 460, the method 450 may then include closing the third valve 406, and, e.g., thereafter, opening the first valve 402, to prepare the flow into the drill string 314 via the second or "alternate" path: however, at this point, the first flow into the drill string 314 may still be provided via the primary flow path (e.g., via line 322). In particular, this may initiate mud flow through the alternate mud supply line 400, and stop the return flow of mud via the fourth valve 410 and the flow line 408.

The method 450 may then proceed to breaking the connection 323 between the tubulars 320, 321, as at 462. In an embodiment, the top drive 304 may supply the torque to break out the connection 323, but in other embodiments, the system 300 may employ other structures or devices (e.g., tongs). Accordingly, in some embodiments, the make-up torque between at least some of the tubulars of the drill string 314 may or may not be configured to allow the top drive 304 to provide such torque. Breaking the connection 323 at 462 may allow for the initiation of the mud flow through the alternate mud supply line 400, while some mud flow may still be provided simultaneously by the mud supply line 322 (i.e., both the first and second mud flows may be at least partially active).

The method 450 may then include closing the second valve 404, as at 464, thereby stopping the first flow. Mud flow into the wellbore 301 may continue circulating via the alternate mud supply line 400 and the alternate flow line 408 (i.e., the second flow).

Further, the top drive 304 may remain capable of lifting the upper tubular 320. As such, the method 450 may include moving the lower connection 323 of the upper tubular 320 to a position above the BOP annular 352 and below the RCD seal 350, as at 466. The rest of the drill string 314 (below the broken connection 323) may stay held by the tubular lock 356 at the same position in the wellbore 301. The BOP annular 352 may then be closed, as at 468, so as to seal the BOP 332 below the lower connection 323 of the upper tubular 320. Next, pressure in the area between the RCD seal 350 and the BOP annular 352 may be bled, as at 470, e.g., via the bleed line 414, by opening the fifth valve 412.

At 472, the upper tubular 320 (above the broken connection 323) may then be moved upwards, until its lower end (i.e., previously part of the connection 323) is pulled out of the RCD 330. The tubular 320 may be removed after being disconnected from the neck 318. As at 474, with the tubular 320 removed, the pin of the neck 318 is cleaned and covered with a layer of grease. Additional details regarding the application of grease to the neck 318 are provided below, with reference to FIG. 7. As also indicated at 474, the neck 318 of the shaft 316 may be lowered past the RCD seal 350 and into the RCD 330, e.g., after the grease is applied.

The fifth valve 412 may then be closed, and the pressure inside the RCD 330 may be equilibrated in comparison with the pressure below the BOP annular 352 by opening the second valve 404, as at 476. Then the BOP annular 352 may be opened, as at 478, followed by the closing of the first valve 402 to avoid to washing away the grease on the pin of the neck 318.

As shown at 480, the neck 318 may be lowered below the BOP annular 352, and may then be connected with the drill string 314. The method 450 may also include resuming the first flow of mud, through the top drive 304. Make-up torque may be applied via the top drive 304, while the reaction torque is transmitted to the tubular lock 356. The method 450 may also opening the pipe ram 354 and the tubular lock 356, as at 482. Then the drill string 314 may be moved upwards so the lower connection 323 of the new upper joint is above the pipe ram 354 and tubular lock 356, as at 484. The method 450 may then include determining whether another joint is to be removed, as at 486. If another joint is to be removed, the method 450 may loop back to 458, and begin proceeding back through the subsequent blocks.

Figure 5A:
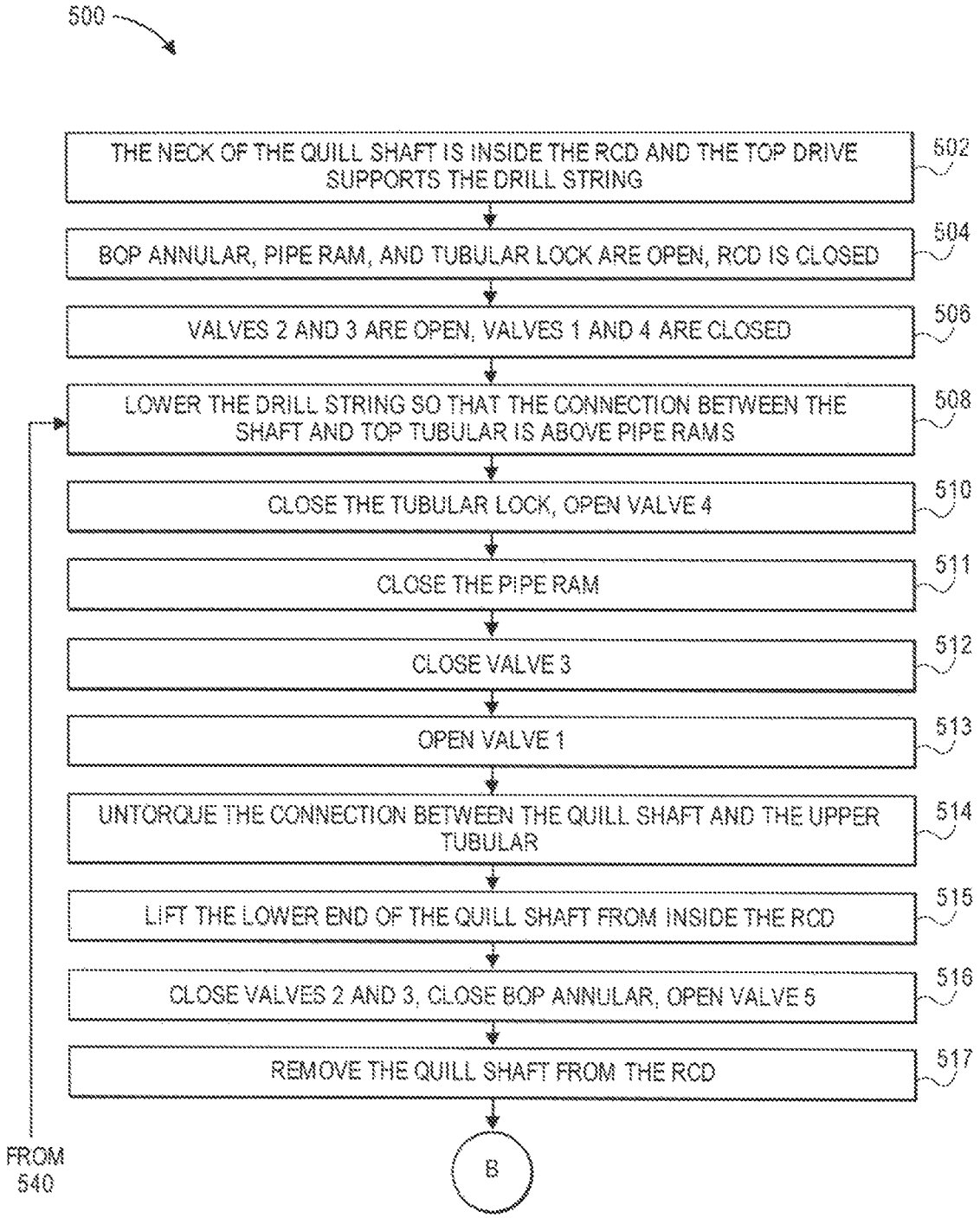
FIGS. 5A and 5B illustrate another flowchart of a method for continuous mud circulation during a drilling operation (e.g., during trip-in), according to an embodiment.
Figure 5B:
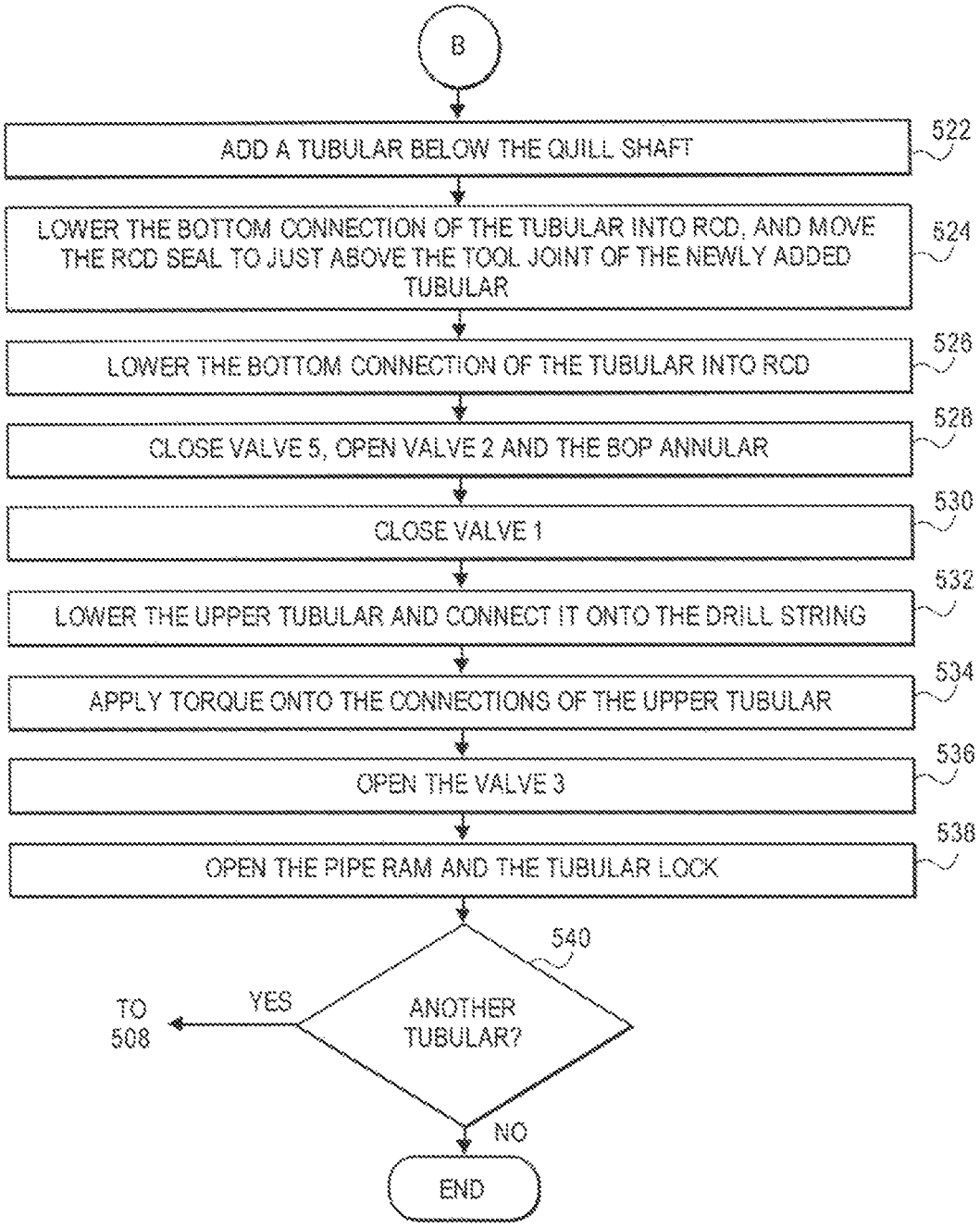

With continuing reference to FIG. 3, FIGS. 5A and 5B illustrate a flowchart of a method 500 for continuous circulation during a drilling process, such as trip-in, according to an embodiment. The initial condition of the system 300 at the start of the method 500, according to an embodiment, is as indicated at 502, with the drill string 314 connected to and supported by the top drive 304, via connection with the shaft 316 thereof, and the neck 318 of the quill shaft 316 positioned inside of the RCD 330. Further, in an embodiment, mud pumping may have been occurring prior to the start of the method 500. Accordingly, the BOP annular 352, pipe ram 354, and tubular lock 356 may be open, while the RCD seal 350 may be engaged with the shaft 316 or the drill string 314, thereby sealing the wellbore 301, as at 504.

Further, as indicated at 506, the second and third valves 404, 406 may be open, allowing for the mud delivered by the pump 362 to flow through the primary flow path (e.g., via lines 322 and 364). Correspondingly, the first and fourth valves 402, 410 may be closed, blocking the second flow.

The method 500 may include lowering the drill string 314 by lowering the top drive 304, until the shaft 316 is pushed into the BOP 332, such that the connection between the upper tubular 320 and shaft 316 is situated immediately above the pipe ram 354, as at 508. The tubular lock 356 may then be closed onto the drill string 314, and the fourth valve 410 may be opened, as at 510. Further, the pipe ram 354 may be closed, as at 511, the third valve 406 may be closed, as at 512, and the first valve 402 may be opened, as at 513.

The connection between the upper pipe and the shaft 316 may then be disconnected, as at 514. During this transition period, mud flow from the pump 362 may enter the drill string 314 according to the primary flow path, via the line 322 and the top drive 304, and via the secondary flow path, via the mud supply line 400.

The top drive 304 may be moved upwards to bring the lower connection of the shaft 316 inside the RCD 330, as at 515. As indicated at 516, the second and third valves 404, 406 may then be closed, along with the BOP annular 352. The mud flow delivered by the pump 362 is still active via the alternate mud supply line 400, and back, e.g., to the choke 366, which may be fully open, via the flow line 408. Finally, the fifth valve 412 may be opened to bleed the pressure inside the RCD 330.

The shaft 316 may then be removed from the RCD 330, e.g., by lifting the top drive 304, as at 517. Further, in an embodiment, the RCD seal 350, which may include a bearing assembly, may be disengaged from a body of the RCD 330, such that the RCD seal 350 travels upwards with the shaft 316 as the top drive 304 is lifted, and thus is moved to a location above the rig floor 420 e.g., by the RCD seal locator 416, while the RCD seal 350 is still on the shaft 316.

As at 522, the new tubular 320 is connected to shaft 316 the top drive 304. Next, at 524, the RCD seal 350 is moved to a position (slightly) above the lower connection of the newly added tubular 320. At 526, the top drive 304 moves downwards so that the lower connection of the newly added tubular 320 is pushed into the RCD 330, until the lower connection 323 of the new tubular 320 is above the BOP annular 352 (which is closed). The RCD seal 350 (with its bearing assembly) is re-engaged in the RCD 330 and it is latched in place.

At 528, the fifth valve 412 may be closed. Further, the second valve 404 may be opened to equalize the pressure across the BOP annular 352, and then the BOP annular 352 may be opened. Then the first valve 402 may be closed, as at 530. The upper tubular 320 may then be lowered by moving the top drive 304 downward, until its lower connection is engaged in the upper connection of the drill string 314 in the BOP 332, so that the connection with drill string 314 is made, as at 532. Torque is applied at 534, e.g., by the top drive 304 onto the upper tubular 320 so that the connections at both extremities may be torqued to a predetermined amount. The tubular lock 356 may ensure back-up torque is provided.

The method 500 may also include opening the third valve 406 to balance the pressure across the pipe ram 354, as at 536. The method 500 may then include opening the pipe ram 354 and the tubular lock, as at 538. The method 500 may then proceed to determining whether another tubular joint is to be added, as at 540. If another tubular is to be added, the method 500 may return to block 508. Otherwise, the method 500 may end and subsequent tasks, which may include continued pumping, may be performed. Drilling may also be engaged.

Figure 6B:
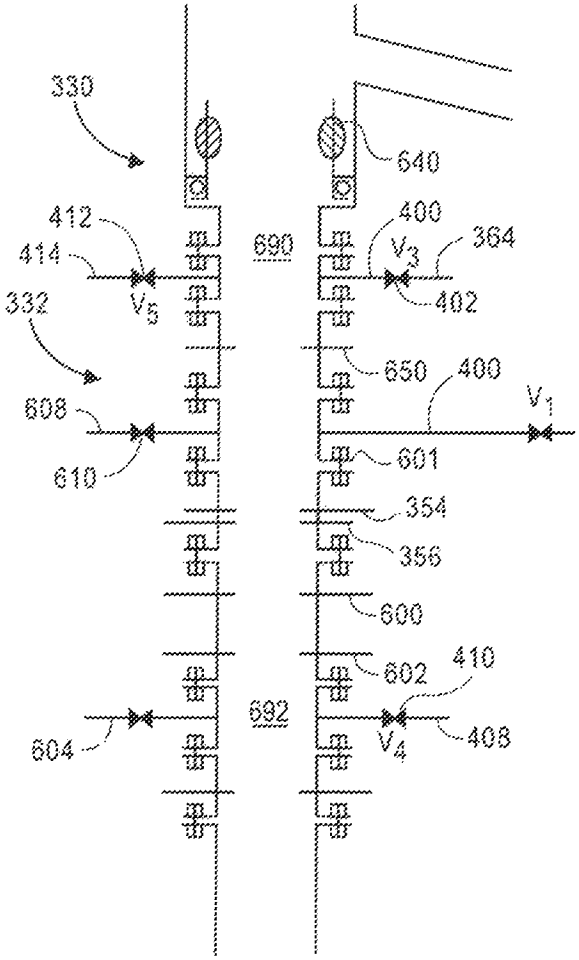
FIGS. 6A and 6B illustrate two more-detailed, schematic views of a portion of the drilling system, showing a blowout preventer and a rotating control device, according to two embodiments.
Figure 6A:
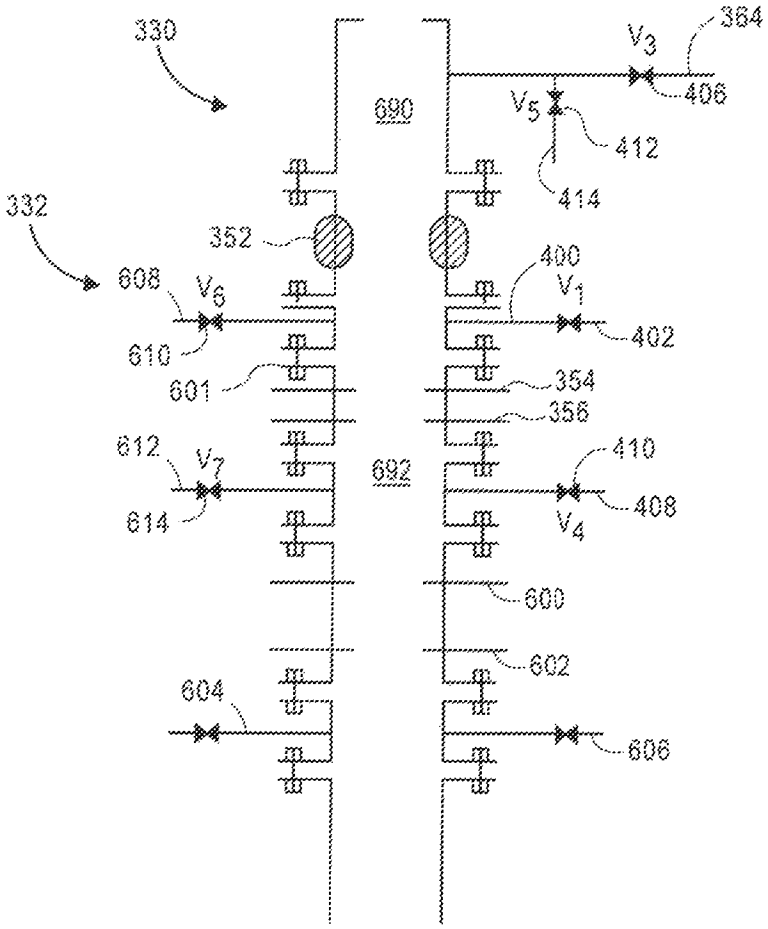

FIG. 6A illustrates a more-detailed, schematic, view of the BOP 332 and the RCD 330, according to an embodiment. As also shown in FIG. 3, the BOP 332 includes the BOP annular 352, the pipe ram 354, and the tubular lock 356. The line 400 connects with the BOP 332 between the BOP annular 352 and the pipe ram 354, and the line 408 connects with the BOP 332 below the tubular lock 356. Several flanges 601 may be provided between the portions of the BOP 332; however, it will be appreciated that the number and positioning of these flanges 601 is merely an example.

The RCD 330 may define a first chamber 690 at least partially therein, and the BOP 332 may define a second chamber 692 at least partially therein. The primary flow line 364 may communicate with the first chamber 690, and the secondary flow line 408 may communicate with the second chamber 692. Thus, during use of the primary flowpath, fluid may be received out of the first chamber 690, while during use of the secondary flowpath, fluid may be received out of the second chamber 692. Moreover, the first and second chambers 690, 692 may be prevented, e.g., selectively, from communicating with one another, e.g., via the BOP annular 352, tubular lock 356, the pipe ram 354, or a combination thereof.

The BOP 332 may additionally include several well-safety devices. For example, the BOP 332 may include a shear or blind ram 600, e.g., below the pipe ram 354, and an additional ram 602 below that. The BOP 332 may also include a kill line 604, which may provide a conduit for injection of a fluid or slurry intended to kill the well. The BOP 332 may also provide a choke line 606, which may allow for reducing the pressure within the well, e.g., as part of a well kill.

The BOP 332 may additionally be coupled to a line 608 and a sixth valve 610, which may control flow through the line 608. The line 608 may be connected with the BOP 332 at a position between the pipe ram 354 and the BOP annular 352, e.g., in a similar vertical location as the line 400. Further, the BOP 332 may be coupled to a line 612 and a seventh valve 614, e.g., between the shear ram 600 and the tubular lock 356, e.g., in a similar vertical position as the line 408. The seventh valve 614 may control fluid flow through the line 612. The sixth valve 610 may be opened in order to balance pressure prior to opening the first valve 402, so as to avoid damage thereto. Similarly, the seventh valve 614 may be opened in order to balance pressure prior to opening the fourth valve 410. The line 608 can be either connected to the pump 362 for pressurization below the annular 352. The line 608 can also be connected to a discharge tank when, to bleed the pressure below the annular.

FIG. 6B illustrates a more-detailed, schematic view of the RCD 330 and the BOP 332, according to another embodiment. In this embodiment, the RCD 330 includes a rotary annular seal 640, which may provide a combined functionality of the RCD seal 350 and the BOP annular 352. The rotary annular seal 640 may be capable of rotating along with a tubular, similar to the RCD seal 350, relative to the BOP 332, and may be activated to seal against the tubular as any annular preventer. When not activated (sealed) against the tubular, the tubular and its connection may be passed through the "open" rotary annular seal 640. Thus, the annular sealing element 640 may not be raised above the rig floor. In addition, the choke line 606 (FIG. 6A) may be combined with the line 408, such that an extra choke line may be omitted.

Further, the BOP 332 of FIG. 6B may include an additional pipe ram 650. The pipe ram 650 may be configured for repetitive use, e.g., after each pipe (or stand of two, three, or more pipes) is tripped in or out (e.g., according to the methods 450, 500, discussed above). Accordingly, the modified pipe ram 650 may serve a purpose similar to the BOP annular 352 described above with reference to FIG. 3, and may be capable of engaging and sealing with the drill string 314 potentially thousands of times in drilling a single well.

Figure 7:
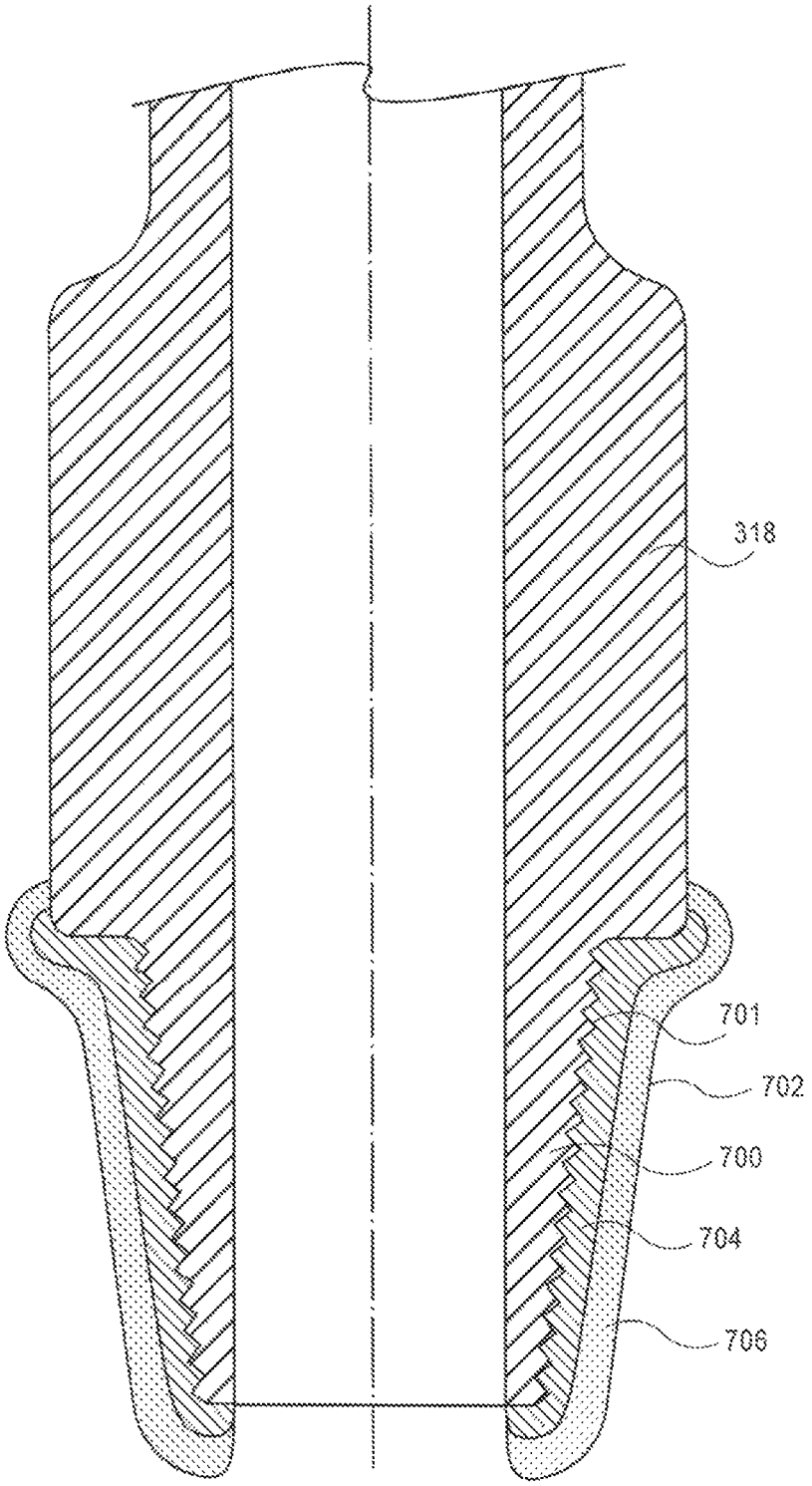
FIG. 7 illustrates a cross-sectional, schematic view of a neck of a top drive, according to an embodiment.

FIG. 7 illustrates a cross-sectional view of the neck 318 that is part of or attached to the top drive 304, according to an embodiment. The neck 318 has a lower connection end 700, which may be a male or "pin" end, providing external threads 701 and a reduced diameter, for connecting with a female or "box" end of a drill pipe. As explained above with respect to FIGS. 4A and 4B, during trip-out, the neck 318 may be lowered into the BOP 332 and connected with the upper connection of the upper-most drill pipe of the drill string 314, e.g., while mud is continuously circulated in the BOP 332. This may result in the connection between the pin end 700 and the drill pipe occurring within the mud.

To avoid the mud fouling the connection, the method 450, as mentioned above, includes covering the pin 700 with grease 704 and 702 at 474. The grease may be formed in two (or more) layers 704, 706 of different types of grease. The first layer 704 may be applied directly to the threads 701. The first layer 704 of grease may serve to lubricate the threads 701, so as to facilitate making the connection with the subjacent tubular, preventing galling, etc. The second layer 706 may be applied over the first layer 704, e.g., such that the first layer 704 is between the threads 701 and the second layer 706.

The second layer 706 may be a "flushing" layer of grease 702. For example, the second layer 706 may have a lower viscosity than the first layer 704, and thus tends to flow more readily than the first layer 704. As a connection is made, the pin end 700 is received into the box end of a subjacent tubular (e.g., the upper-most tubular 320 of the drill string 314), and the second, flushing layer 706 may be pushed upward, away from the threads, by the advancement of the box end of the subjacent tubular. As such, particulate matter (e.g., mud) may be moved along with the second, flushing layer 706, and prevented from being entrained between the threads of the box and pin ends, while the first, lubricating layer 704 facilitates the engagement between the ends. It will be appreciated that the dual grease layer arrangement may also be applied to a lower end of another type of tubular, such as the new tubular 320 to be connected to the drill pipe 314, so as facilitate making a connection between the tubular 320 and the drill string 314 within the BOP 332.

Further, in some embodiments, the top drive assembly 304 may be provided with an axial brake. The axial brake may be provided to resist the tubular 320 being pushed upwards by pressure in the BOP 332, as provided by the alternate mud supply line 400 or by the primary mud supply line 322.

Figure 8:
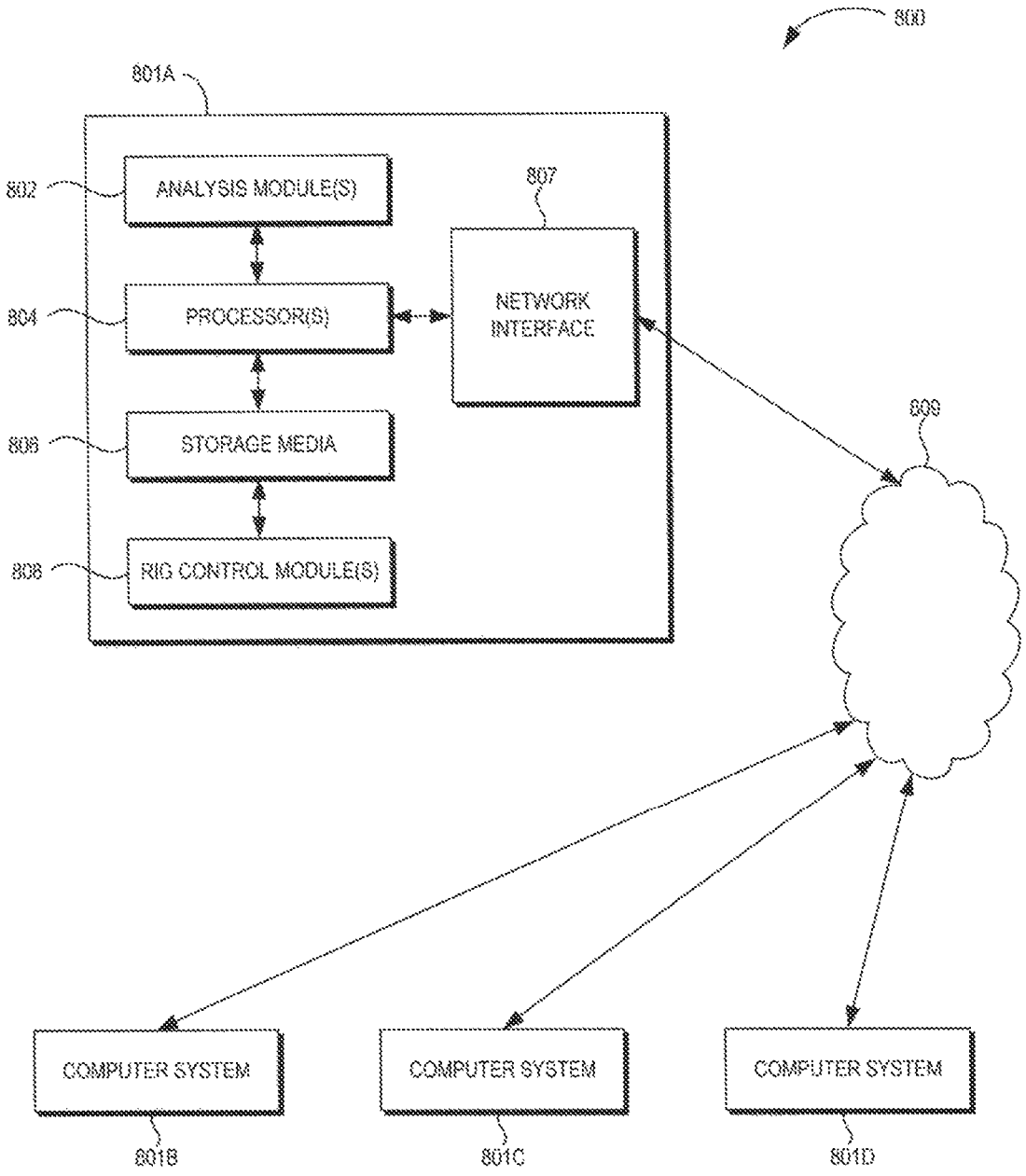
FIG. 8 illustrates a schematic view of a computing system, according to an embodiment.

In some embodiments, the methods of the present disclosure may be executed by a computing system. FIG. 8 illustrates an example of such a computing system 800, in accordance with some embodiments. The computing system 800 may include a computer or computer system 801A, which may be an individual computer system 801A or an arrangement of distributed computer systems. The computer system 801A includes one or more analysis modules 802 that are configured to perform various tasks according to some embodiments, such as one or more methods disclosed herein. To perform these various tasks, the analysis module 802 executes independently, or in coordination with, one or more processors 804, which is (or are) connected to one or more storage media 806. The processor(s) 804 is (or are) also connected to a network interface 807 to allow the computer system 801A to communicate over a data network 809 with one or more additional computer systems and/or computing systems, such as 801B, 801C, and/or 801D (note that computer systems 801B, 801C and/or 801D may or may not share the same architecture as computer system 801A, and may be located in different physical locations, e.g., computer systems 801A and 801B may be located in a processing facility, while in communication with one or more computer systems such as 801C and/or 801D that are located in one or more data centers, and/or located in varying countries on different continents).

A processor may include a microprocessor, microcontroller, processor module or subsystem, programmable integrated circuit, programmable gate array, or another control or computing device.

The storage media 806 may be implemented as one or more computer-readable or machine-readable storage media. Note that while in the example embodiment of FIG. 8 storage media 806 is depicted as within computer system 801A, in some embodiments, storage media 806 may be distributed within and/or across multiple internal and/or external enclosures of computing system 801A and/or additional computing systems. Storage media 806 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURRY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 800 contains one or more mixer control module(s) 808. In the example of computing system 800, computer system 801A includes the mixer control module 808. In some embodiments, a single mixer control module may be used to perform some or all aspects of one or more embodiments of the methods disclosed herein. In alternate embodiments, a plurality of mixer control modules may be used to perform some or all aspects of methods herein.

It should be appreciated that computing system 800 is only one example of a computing system, and that computing system 800 may have more or fewer components than shown, may combine additional components not depicted in the example embodiment of FIG. 8, and/or computing system 800 may have a different configuration or arrangement of the components depicted in FIG. 8. The various components shown in FIG. 8 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A method for continuous mud circulation during a drilling operation, comprising:

delivering a first flow of drilling mud from a mud supply, through a drilling device and a drill string, into a well bore, and through a blowout preventer, wherein the drill string is received through the blowout preventer;

delivering a second flow of drilling mud into the blowout preventer and into the well bore, wherein the second flow is not delivered through the drilling device;

stopping the first flow; and removing or adding a tubular to or from the drill string when the first flow is stopped and while continuing to deliver the second flow, wherein removing or adding the tubular to or from the drill string comprises preventing the drill string from rotating using a tubular lock of the blowout preventer.

2. The method of claim 1, wherein, while delivering the first flow, the first flow of drilling mud is received from a rotating control device coupled to the blowout preventer and into a first flow line connected to the rotating control device, the rotating control device being configured to seal and rotate with the tubular.

3. The method of claim 2, wherein, while delivering the second flow, the second flow is delivered into the blowout preventer and received out of the blowout preventer into a second flow line connected to the blowout preventer.

4. The method of claim 3, wherein the rotating control device at least partially defines a first chamber above the well, and the blowout preventer at least partially defines a second chamber above the well, wherein the first flow line is in communication with the first chamber, and the second flow line is in the communication with the second chamber, the method further comprising:

receiving fluid from the first chamber into the first flow line, while delivering the first flow; and receiving fluid from the second chamber into the second flow line, while delivering the second flow.

5. The method of claim 4, further comprising preventing the second chamber from communicating with the first chamber while delivering the second flow.

6. The method of claim 4, further comprising supporting the tubular string below the first and second chambers and in the wellbore.

7. The method of claim 1, further comprising:

after removing or adding the tubular:

stopping the second flow; and again delivering the first flow at least while the second flow is stopped.

8. The method of claim 1, wherein delivering the first flow further comprises delivering the first flow to the drill string via a drilling device coupled to the drill string, wherein the second flow is not circulated through the drilling device.

9. The method of claim 8, wherein, at least partially during adding or removing the tubular, the tubular and the drilling device are disconnected from one another, or the tubular and the drill string are disconnected from one another, or both.

10. The method of claim 9, further comprising:

moving a lower connection of the tubular below a rotating control device coupled to the blowout preventer and configured to seal with and rotate with the tubular, and above an annular seal of the blowout preventer;

closing the annular seal;

bleeding pressure inside the rotating control device; and removing the tubular out of the rotating control device.

11. The method of claim 8, further comprising positioning the drilling device, while delivering the second flow, such that a connection between a shaft of the drilling device and the tubular is above a seal of a rotating control device through which the drill string is received, the rotating control device being configured to seal with and rotate with the tubular.

12. The method of claim 11, further comprising:

positioning a connection between the tubular and a subjacent tubular of the drill string below the rotating control device and below an annular seal and above a pipe ram of the blowout preventer; and breaking the connection between the tubular and the subjacent tubular while the connection is positioned below the rotating control device.

13. The method of claim 12, further comprising:

applying a first layer of grease to threads of a lower connection of the tubular, and applying a second layer of grease over the first layer of grease; and lowering the tubular at least partially into the blowout preventer and into engagement with the drill string after applying the first and second layers of grease.

14. The method of claim 12, wherein removing or adding the tubular comprises adding the tubular, and wherein adding the tubular comprises connecting the tubular to the drilling device, the method further comprising:

connecting a lower end of the tubular to a drill string supported in a blowout preventer, while delivering the first flow;

lowering the tubular partially through the blowout preventer;

supporting the tubular, attached to the drill string, in the blowout preventer;

disconnecting the drilling device from the tubular when the tubular is supported in the blowout preventer; and raising the drilling device relative to the tubular, to accept another tubular.

15. The method of claim 14, further comprising applying a first layer of grease to threads of the lower end of the tubular, and applying a second layer of grease over the first layer of grease, prior to connecting the lower end of the tubular to the drill string, wherein the first layer of grease has a higher viscosity than the second layer of grease.

16. The method of claim 1, further comprising raising an annular seal of a rotating control device away from the blowout preventer when raising the drilling device, wherein the annular seal is configured to rotate with and form a seal with a shaft of the drilling device, and wherein at least a portion of the rotating control device coupled to the blowout preventer.

17. A system for drilling a wellbore, comprising:

a blowout preventer configured to be disposed above a wellbore, wherein the blowout preventer is configured to receive a drill string therethrough;

a rotating control device coupled to the blowout preventer, such that the blowout preventer is configured to be positioned between the wellbore and the rotating control device, wherein the rotating control device is configured to receive the drill string therethrough;

a drilling device configured to rotate the drill string and lower the drill string through the blowout preventer and the rotating control device, wherein the drilling device has a conduit that is configured to communicate with an inner bore of the drill string;

a first mud supply line fluidly coupled to the drilling device, so as to deliver a first mud flow into the drill string via the drilling device; and a second mud supply line coupled to the blowout preventer, so as to deliver a second mud flow thereto, wherein the second mud flow does not extend through the drilling device, wherein the blowout preventer comprises a tubular lock configured to engage the drill string and prevent the drill string from rotating relative to the wellbore, so as to permit forming or breaking a connection between the drilling device and the drill string within the blowout preventer.

18. The system of claim 17, wherein the first and second mud supply lines are coupled together, wherein the system further comprises a first valve coupled to the first mud supply line, and a second valve coupled to the second mud supply line, and wherein the first and second valves are configured to selectively permit and block flow through the first and second mud supply lines, respectively.

19. The system of claim 17, further comprising:

a first flow line coupled to a first sealable chamber defined at least partially by the rotating control device and configured to receive the first mud flow therefrom; and a second flow line coupled to a second sealable chamber defined at least partially by the blowout preventer and configured to receive the second mud flow therefrom.

20. The system of claim 19, further comprising a choke for managed pressure drilling, wherein the first flow line and the second flow line deliver the first and second mud flows, respectively, to the choke.

21. The system of claim 20, further comprising a third valve coupled to the first flow line, and a fourth valve coupled to the second flow line.

22. The system of claim 20, further comprising a pressure bleed line coupled to the rotating control device, and a fifth valve coupled to the pressure bleed line.

23. The system of claim 20, wherein the blowout preventer further comprises a pipe ram configured to support the drill string, wherein the second flow line is connected to the blowout preventer between the pipe ram and the tubular lock.

24. The system of claim 17, wherein the drilling device comprises a top drive.

25. The system of claim 17, wherein the rotating control device comprises an annular seal that is configured to rotate with and form a seal with a shaft of the drilling device, and wherein the annular seal is configured to be lifted away from the blowout preventer.

* * * * *